US010358748B2

(12) United States Patent
Sugimoto et al.

(10) Patent No.: US 10,358,748 B2
(45) Date of Patent: Jul. 23, 2019

(54) PROTECTIVE WOVEN FABRIC AND PROCESS FOR PRODUCING SAME

(71) Applicant: The Japan Wool Textile Co., Ltd., Kobe-shi, Hyogo (JP)

(72) Inventors: Ichiro Sugimoto, Ishikawa (JP); Keita Tasaki, Aichi (JP)

(73) Assignee: The Japan Wool Textile Co., Ltd., Hyogo (JP)

( * ) Notice: Subject to any disclaimer, the term of this patent is extended or adjusted under 35 U.S.C. 154(b) by 0 days.

(21) Appl. No.: 15/546,222

(22) PCT Filed: Jan. 18, 2016

(86) PCT No.: PCT/JP2016/051217

§ 371 (c)(1),
(2) Date: Jul. 25, 2017

(87) PCT Pub. No.: WO2016/121545

PCT Pub. Date: Aug. 4, 2016

(65) Prior Publication Data

US 2018/0016713 A1 Jan. 18, 2018

(30) Foreign Application Priority Data

Jan. 26, 2015 (JP) ..... 2015-012704

(51) Int. Cl.
*D03D 15/12* (2006.01)
*D03D 15/00* (2006.01)
(Continued)

(52) U.S. Cl.
CPC ..... *D03D 1/0041* (2013.01); *D02G 3/04* (2013.01); *D02G 3/047* (2013.01); *D02G 3/18* (2013.01);
(Continued)

(58) Field of Classification Search
CPC .... D03D 15/12; D03D 15/00; D03D 15/0011; D03D 15/0016; D03D 15/0027;
(Continued)

(56) References Cited

U.S. PATENT DOCUMENTS 4,384,449 A * 5/1983 Byrnes, Sr. ..... A41D 19/01511 139/425 R
5,141,542 A * 8/1992 Fangeat ..... A41D 31/0022 428/364
(Continued)

FOREIGN PATENT DOCUMENTS

JP 3-220335 9/1991
JP 3051449 6/2000
(Continued)

OTHER PUBLICATIONS

Office Action issued in corresponding Chinese Patent Application No. 201680002421.5, dated May 3, 2018, 8 pages with a partial translation.
(Continued)

*Primary Examiner* — Robert H Muromoto, Jr.
(74) *Attorney, Agent, or Firm* — Hamre, Schumann, Mueller & Larson, P.C.

(57) ABSTRACT

A protective woven fabric of the present invention includes super fiber yarns. The warp of the woven fabric is a covered yarn (1, 4, 5) composed of two or more twisted inorganic filament yarns as core yarns (2*a*, 2*b*) and one or more super fiber yarns (3, 3*a*, 3*b*, 3*c*) as covering yarns that are wound and twisted around the core yarns (2*a*, 2*b*), and a weft thereof is a super fiber yarn. Preferably, the covered yarn is a W covered yarn in which a twist coefficient K of the covering yarns with respect to the core yarns is 2000 to 30000. Due to this, it is possible to provide a protective woven fabric that, even when the warp and the weft is squeezed or rubbed by the reed, heddles, etc., of a loom, has
(Continued)

few defects such as fluff or fiber aggregates and which has a satisfactory weaving pattern while retaining a high protective function. A force required to cut this woven fabric is 50 N or more, preferably 60 N or more, as measured through a cutting test in accordance with JIS-T8052, even when the fabric is a monolayer woven fabric.

12 Claims, 7 Drawing Sheets

(51) Int. Cl.

| | |
|---|---|
| ***D03D 1/00*** | (2006.01) |
| ***D02G 3/04*** | (2006.01) |
| ***D02G 3/26*** | (2006.01) |
| ***D02G 3/36*** | (2006.01) |
| ***D03D 11/00*** | (2006.01) |
| ***D02G 3/18*** | (2006.01) |
| ***D03D 15/08*** | (2006.01) |

(52) U.S. Cl.
CPC ..... *D02G 3/26* (2013.01); *D02G 3/36* (2013.01); *D03D 11/00* (2013.01); *D03D 15/0011* (2013.01); *D03D 15/0027* (2013.01); *D03D 15/08* (2013.01); *D03D 15/12* (2013.01); *D10B 2101/06* (2013.01); *D10B 2101/12* (2013.01); *D10B 2321/06* (2013.01); *D10B 2331/021* (2013.01); *D10B 2331/042* (2013.01); *D10B 2331/061* (2013.01); *D10B 2331/14* (2013.01); *D10B 2501/04* (2013.01)

(58) Field of Classification Search
CPC .. D03D 15/02; D03D 1/0041; A41D 31/0022; A41D 19/01511; D02G 3/443; D02G 3/12; D02G 3/185; D02G 3/36; D02G 3/442; A62B 17/003
See application file for complete search history.

(56) References Cited

U.S. PATENT DOCUMENTS

| | | | | |
|---|---|---|---|---|
| 5,187,003 | A | 2/1993 | Chitrangad | |
| 6,045,884 | A * | 4/2000 | Hess | D03D 3/02 138/123 |
| 6,340,510 | B2 * | 1/2002 | Hess | D03D 3/02 138/123 |
| 8,209,948 | B2 * | 7/2012 | Takahashi | A62B 17/003 57/210 |
| 2001/0004481 | A1 * | 6/2001 | Hess | D03D 3/02 428/36.1 |
| 2002/0011062 | A1 | 1/2002 | Patrick | |
| 2009/0183296 | A1 | 7/2009 | Hardee et al. | |
| 2010/0205723 | A1 * | 8/2010 | Takahashi | A62B 17/003 2/458 |

FOREIGN PATENT DOCUMENTS

| | | |
|---|---|---|
| JP | 2002-069788 | 3/2002 |
| JP | 2002-371408 | 12/2002 |
| JP | 2008-208512 | 9/2008 |
| JP | 2011-074550 | 4/2011 |
| JP | 2011-511175 | 4/2011 |
| JP | 5156410 | 3/2013 |
| WO | 02/40755 | 5/2002 |

OTHER PUBLICATIONS

Extended European Search report issued in corresponding European Patent Application No. 16743149.3, dated Aug. 8, 2018, 18 pages.

* cited by examiner

PROTECTIVE WOVEN FABRIC AND PROCESS FOR PRODUCING SAME

TECHNICAL FIELD

The present invention relates to a protective woven fabric that is high in strength and shock resistance and that is composed of high strength high elasticity fiber yarns. More specifically, the present invention relates to a protective woven fabric having a satisfactory weaving pattern, and a method for producing the same.

BACKGROUND ART

Woven fabrics made from high strength high elasticity fibers such as aramid fibers have been proposed conventionally as protective woven fabrics (e.g., knife-resistant clothing, a bulletproof vest) (Patent Documents 1-2). In Patent Document 3, the present inventors propose applying a multi-ply woven fabric having a specific fabric structure and a laminated sheet using the multiply woven fabric to knife-resistant clothing, etc.

PRIOR ART DOCUMENTS

Patent Documents

Patent Document 1: JP 3051449
Patent Document 2: JP 2002-371408A
Patent Document 3: JP 5156410

DISCLOSURE OF INVENTION

Problem to be Solved by the Invention

When the above woven fabric or sheet is applied to the knife-resistant clothing (e.g., a knife-resistant vest, a leg protector for chain saw work), it is placed inside a covering fabric and then the covering fabric is sewn to, e.g., the body part of the vest. In this case, slight defects such as fluff or fiber aggregates on the surface of the fabric do not cause a big problem. However, recently, in addition to the application to the knife-resistant clothing, such a woven fabric or sheet is used alone as, e.g., a vehicle sheet without being placed inside a covering fabric. When used as a vehicle sheet, the woven fabric or sheet may be used by itself. Hence, the woven fabric is required to have a satisfactory weaving pattern.

The present invention provide a protective woven fabric having a satisfactory weaving pattern while retaining a high protective function, and a method for producing the same.

Means for Solving Problem

A protective woven fabric of the present invention is a protective woven fabric including super fiber yarns. The warp of the woven fabric is a covered yarn composed of two or more twisted inorganic filament yarns as core yarns and one or more super fiber yarns as covering yarns that are wound and twisted around the core yarns. The weft of the woven fabric is a super fiber yarn.

A method for producing the protective woven fabric of the present invention is a method for producing the above-described protective woven fabric, wherein at the time of moving the warp upward and downward by a heddle, a distance between a highest point and a lowest point of the warp is 80 mm or more and 120 mm or less.

Effect of the Invention

In the present invention, the warp of the woven fabric is a covered yarn composed of two or more twisted inorganic filament yarns as core yarns and one or more super fiber yarns as covering yarns that are wound and twisted around the core yarns. The weft of the woven fabric is a super fiber yarn. Thus, it is possible to provide a protective woven fabric that, even when the warp and the weft is squeezed or rubbed by the reed, heddles, etc., of the loom, has few defects such as fluff or fiber aggregates and has a satisfactory weaving pattern while retaining a high protective function. Especially, by using as the warp a covered yarn composed of inorganic filament yarns as core yarns and one or more super fiber yarns as covering yarns that are wound and twisted around the surface of the core yarns, the present invention can avoid fabric defects such as fluff or fiber aggregates, which are easily generated when the warp and the weft is squeezed or rubbed by the reed, heddles, etc., of the loom, and the core yarns and the twisted covering yarns are separated.

DESCRIPTION OF THE INVENTION

Figure 1A:
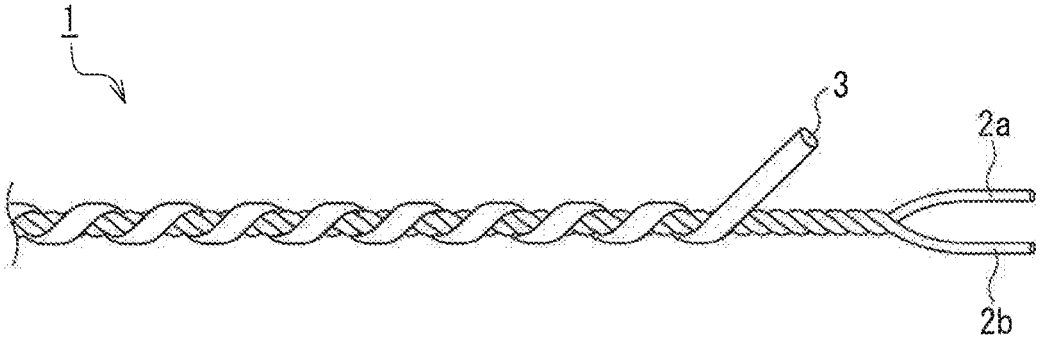
FIG. 1A is a schematic side view of a single covered yarn used as a warp in one embodiment of the present invention.

The warp of the protective woven fabric of the present invention is a covered yarn composed of two or more twisted inorganic filament yarns as core yarns and one or more super fiber yarns as covering yarns that are wound and twisted around the core yarns. The reason for using two or more inorganic filament yarns as core yarns of the warp is to highly integrate the twisted covering yarns with the core yarns and to increase a cutting resistance. The covered yarn may be a single covered yarn or a double covered yarn, preferably a double covered yarn. By using the double covered yarn, a higher force is required to cut the woven fabric.

In the covered yarn, the twist coefficient K of the covering yarns with respect to the core yarns is preferably 2000 to 30000, more preferably 3000 to 26000. This strengthens the twisted structure, and a higher force is required to cut the woven fabric (hereinafter, a force (N) required to cut a woven fabric is referred to as "a woven fabric having a cut resistance force of . . . N"). Consequently, this woven fabric, even when being a monolayer woven fabric, can have a cut resistance force of 50 N or more, preferably 60 N or more in the cutting test in accordance with JIS-T8052.

$$K=T\times D^{1/2}$$

where T represents the number of twists per 1 m of yarn, and

D represents the fineness of the yarn (unit: decitex)

A super fiber yarn alone is used as the weft. This is because the weft receives a large frictional force from warps and a reed during production of a woven fabric, and thus covered yarns such as those used as the warp would be easily separated into core yarns and covering yarns if used as the weft. The term "super fiber" is a general technical term for a person skilled in the art, as described in "Seni no Hyakkajiten (Encyclopedia of Fibers)" written by Tatsuya Motomiya et al., published by Maruzen, Mar. 25, 2002, page 522.

In the covered yarn as the warp, it is preferred that an additional yarn made of a super fiber yarn is arranged with the inorganic filament yarns (core yarns). Thus, the integration of the twisted covering yarns with the core yarns can be increased further, and it becomes possible to obtain a protective woven fabric having few defects such as fluff or fiber aggregates while having a more satisfactory weaving pattern.

The inorganic filament yarns have a twist coefficient K of preferably 500 to 20000, more preferably 1000 to 15000. A plurality of the inorganic filament yarns may be arranged in parallel or twisted in use. In the above, the twist coefficient K is determined by the following formula.

$$K=T\times D^{1/2}$$

where T represents the number of twists per 1 m of yarn, and

D represents the fineness of the yarn (unit: decitex)

The inorganic filament yarn is preferably at least one selected from glass fiber yarns and carbon fiber yarns. Of these, the glass fibers are preferred because they have high viscoelasticity and high resistance against shocks from a weft direction. When the glass fiber yarn is an E-glass fiber yarn, the density is 2.55 g/cm$^3$, the tensile strength is 2410 MPa, and the Young's modulus is 69 GPa. When the carbon fiber yarn is "T1000G" (trade name) manufactured by Toray Industries, Inc., the density is 1.80 g/cm$^3$, the tensile strength is 6370 MPa, and the Young's modulus is 297 GPa. These fiber yarns have high strength, and favorable cutting resistance and shock resistance. It is preferred that the fineness of the inorganic filament yarn is 200 to 2000 decitex, and the total number of single fibers is appropriately 400 to 4000.

The super fiber yarn is preferably a high strength high elasticity fiber yarn having a strength of 18 cN/decitex or more, and an elastic modulus of 380 cN/decitex or more. Specifically, the super fiber is preferably at least one selected from aramid fibers (including para- and meta-aramid fibers), polyarylate fibers, poly(p-phenylenebenzobisoxazole) (PBO) fibers, poly(p-phenylenebenzobisthiazole) (PBZT) fibers, polyethylene fibers, polyether ether ketone fibers, and polyvinyl alcohol fibers. These fibers can be mixed in use. The super fiber yarns of the warp and the weft may be the same or different from each other. Among these, the following are preferred: aramid fibers having high heat resistance (e.g., trade name "Kevlar (registered trademark)" manufactured by DuPont-Toray Co., Ltd., trade name "Twaron (registered trademark)" manufactured by Teijin Twaron B.V., trade name "Technora (registered trademark)" manufactured by Teijin Ltd.); polyarylate fibers (e.g., trade name "Vectran (registered trademark)" manufactured by KURARAY Co., Ltd.); and poly(p-phenylenebenzobisoxazole) (PBO) fibers (e.g., trade name "Zylon (registered trademark)" manufactured by Toyobo Co., Ltd.).

The super fiber yarn may be a multifilament yarn or a spun yarn. The total fineness of the multifilament yarn is preferably about 100 to 3000 decitex (the fineness of the single fiber: 1 to 20 decitex). The fineness of the spun yarn is preferably 1 to 50 (cotton count). The super fiber yarn may be used alone as a single yarn, or a plurality of the super fibers may be arranged in parallel or twisted in use. The multifilament yarn may be a processed yarn.

The protective woven fabric of the present invention is preferably a monolayer woven fabric or a multi-ply woven fabric including 2 to 5 layers. In terms of the production cost, the protective woven fabric is preferably a monolayer woven fabric. Examples of the monolayer woven fabric include plain weave, twill weave, and satin weave. Among these, the twill weave is preferred because of its beautiful weaving pattern. The twill weave may be 1/2 twill, 2/1 twill, 2/2 twill, or the like. The multi-ply woven fabric preferably has a structure in which warps on the both outer sides are each arranged to cross between one weft in the outermost layer, and warps in the inner layers are each arranged to cross between two wefts adjacent to each other in the thickness direction. The multi-ply woven fabric may be composed of 3 to 8 warps and 2 to 7 wefts (layers) seen from the cross-sectional direction.

The protective woven fabric of the present invention preferably has a cut resistance force of 30 N or more, further preferably 50 N or more, and particularly preferably 100 N or more in a cutting test in accordance with JIS-T8052. When the cut resistance force is greater than or equal to 100 N, the fabric is evaluated as "100 N or more". Some of the protective woven fabrics of the present invention actually have a cut resistance force of "100 N or more". Protective woven fabrics having a cut resistance force of 30 N or more in the cutting test have favorable cutting resistance and shock resistance.

It is preferred that the protective woven fabric of the present invention is a monolayer woven fabric, and has a warp density of 50 yarns/2.54 cm or more and a weft density of 35 yarns/2.54 cm or more. It is more preferred that the protective woven fabric is a monolayer woven fabric, and has a warp density of 50 to 80 yarns/2.54 cm and a weft density of 40 to 60 yarns/2.54 cm. With this structure, the protective woven fabric, even when a monolayer woven fabric, can have a cut resistance force of 50 N or more in the cutting test in accordance with JIS-T8052.

The protective woven fabric of the present invention can be used as knife-resistant clothing, heat-resistant sheets, shock-resistant sheets, and the like. Examples of the knife-resistant clothing include knife-resistant vests, and leg protectors for chain saw work. Examples of the heat-resistant sheets include sheets for operations near a furnace such as a blast furnace or aluminum die cast, and sheets for welding. Examples of the shock-resistant sheets include human body protective sheets for fixing a human body to a protective position in a vehicle, and vehicle reinforcing sheets. In addition to these, the protective woven fabric of the present invention can be used at locations in, e.g., vehicles, trains, ships, minesweepers, submarines, chemical plants, and petroleum facilities, that are required to have shock resistance.

Figure 1B:
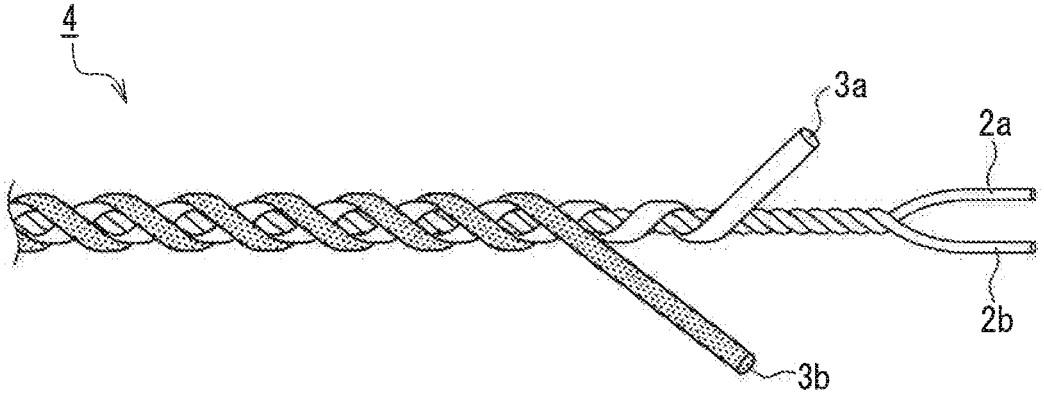
FIG. 1B is a schematic side view of a double covered yarn.
Figure 1C:
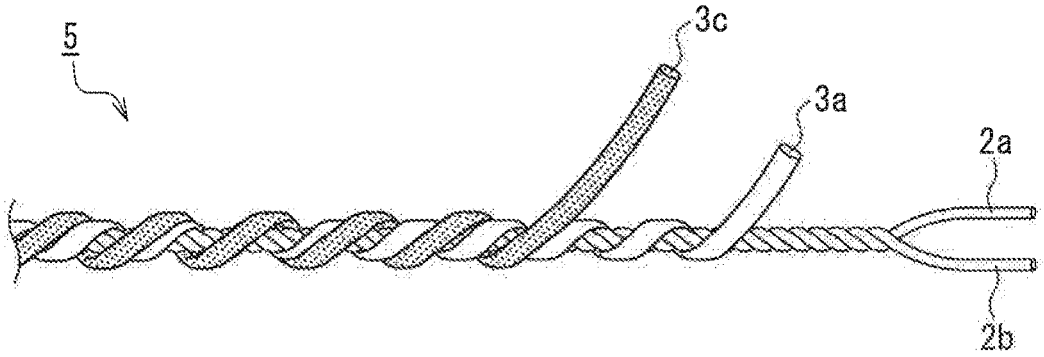
FIG. 1C is a schematic side view of another double covered yarn.

Hereinafter, the present disclosure will be described with reference to the drawings. In the drawings, the same reference numeral denotes the same element. FIG. 1A is a schematic side view of a single covered yarn 1 used as a warp in one embodiment of the present invention. The single covered yarn 1 is composed of two twisted inorganic filament yarns as core yarns 2*a* and 2*b*, and a covering yarn 3 made of super fibers for covering the core yarns. FIG. 1B is a schematic side view of a double covered yarn 4 in which covering yarns 3*a* and 3*b* cover the core yarns. The twist directions of the covering yarns 3*a* and 3*b* differ from each other. FIG. 1C is a schematic side view of another double covered yarn 5. The twist directions of the covering yarns 3*a* and 3*c* are the same. Of these, the double covered yarn 4 of FIG. 1B is preferred because of its strong twisted structure.

Figure 2:
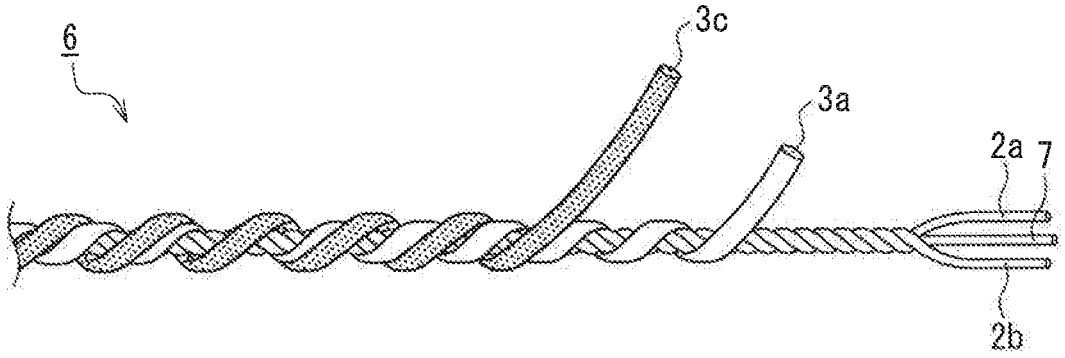
FIG. 2 is a schematic side view of a double covered yarn in which an additional yarn is arranged with core yarns of the warp.

FIG. 2 is a schematic side view of a double covered yarn 6 in which an additional yarn 7 is arranged with the core yarns 2*a* and 2*b* of the warp in another example. A super fiber yarn is used as the additional yarn 7. With this configuration, the integration of the covering yarns with the core yarns can be increased further. A super fiber yarn is used as a weft for the warps of FIGS. 1 and 2.

Figure 3:
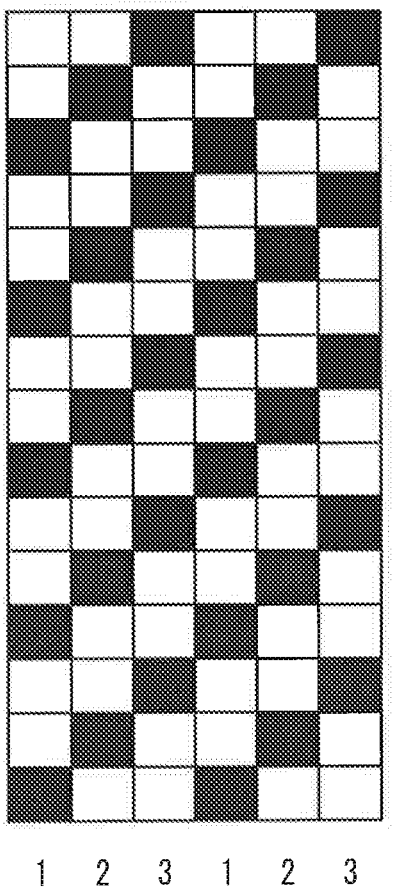
FIG. 3 is a weave diagram of a 2/1 twill woven fabric in one embodiment of the present invention.
Figure 4:
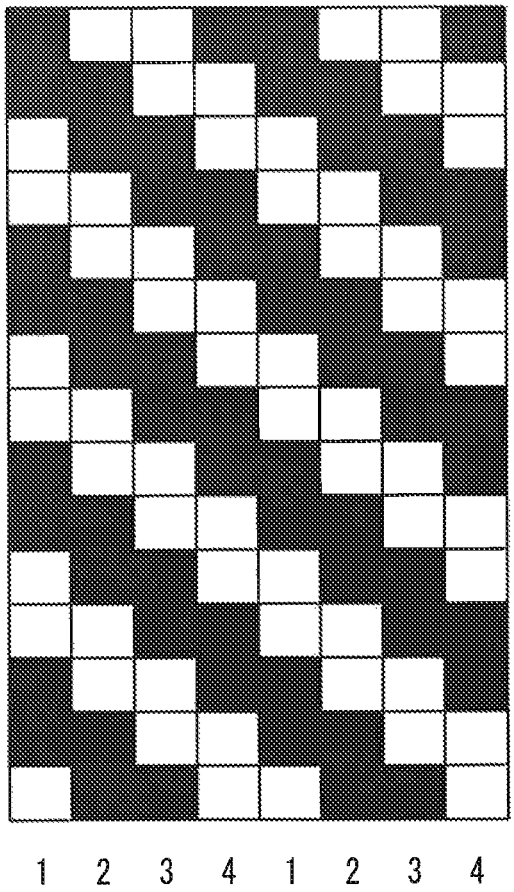
FIG. 4 is a weave diagram of a 2/2 twill woven fabric in another embodiment of the present invention.
Figure 5:
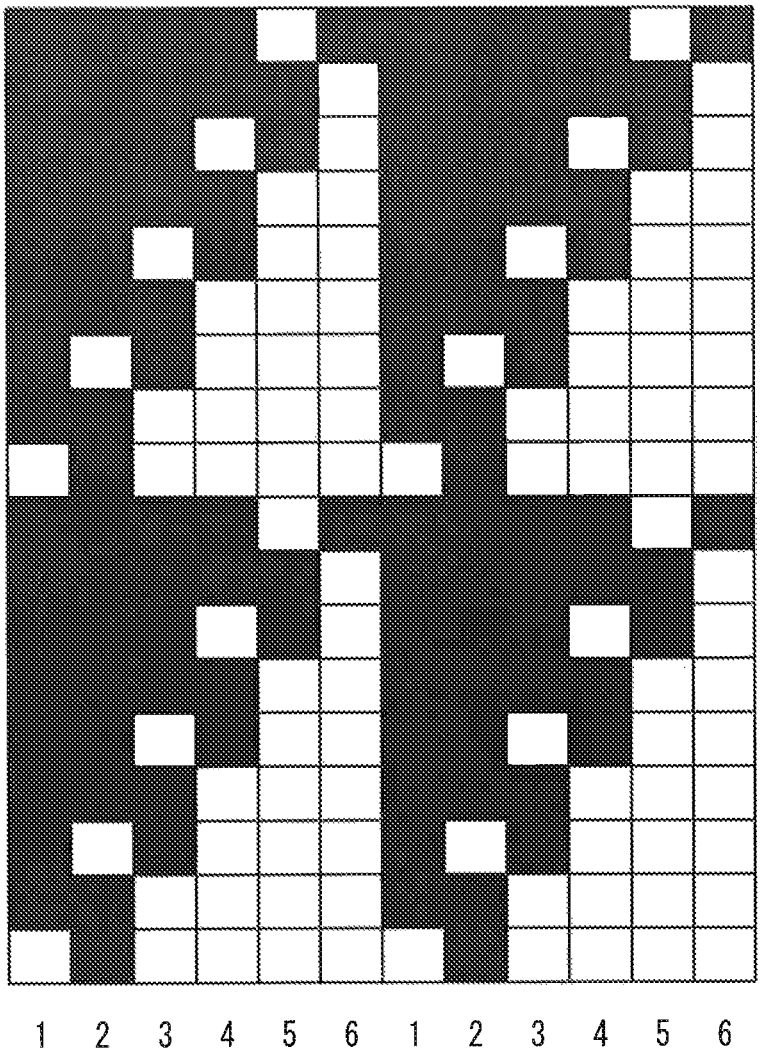
FIG. 5 is a weave diagram of a quadruple plain woven fabric in still another embodiment of the present invention.
Figure 6:
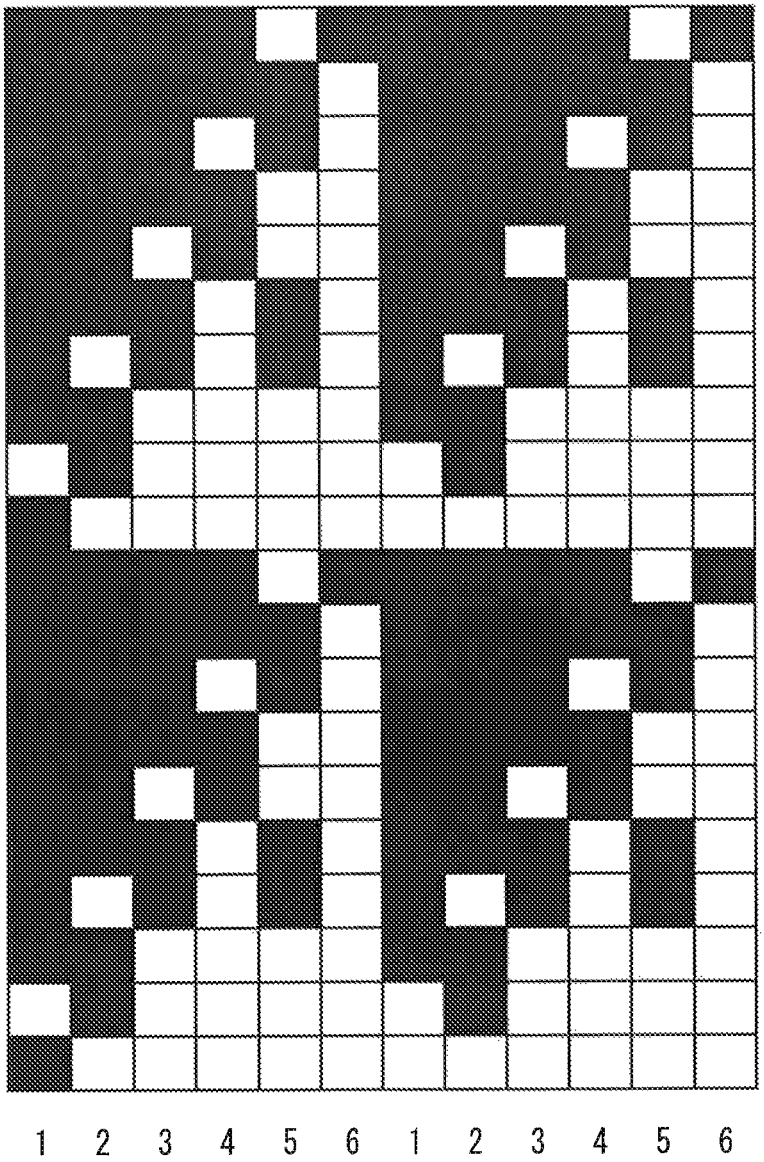
FIG. 6 is a weave diagram of a quintuple plain woven fabric in still another embodiment of the present invention.

FIG. 3 is a weave diagram of a 2/1 twill woven fabric (back, weave, monolayer woven fabric) in one embodiment of the present invention. Black areas are where the warp appears on the face of the fabric. White areas are where the warp is hidden on the back. The numbers 1, 2, and 3 on the lower side of FIG. 3 indicate one cycle. FIG. 4 is a weave diagram of a 2/2 twill woven fabric (monolayer woven fabric) in another embodiment of the present invention. The numbers from 1 to 4 indicate one cycle. FIG. 5 is a weave diagram of a quadruple plain woven fabric in still another embodiment of the present invention. The numbers from 1 to 6 indicate one cycle. FIG. 6 is a weave diagram of a quintuple plain woven fabric in still another embodiment of the present invention. The numbers from 1 to 6 indicate one cycle.

Figure 7:
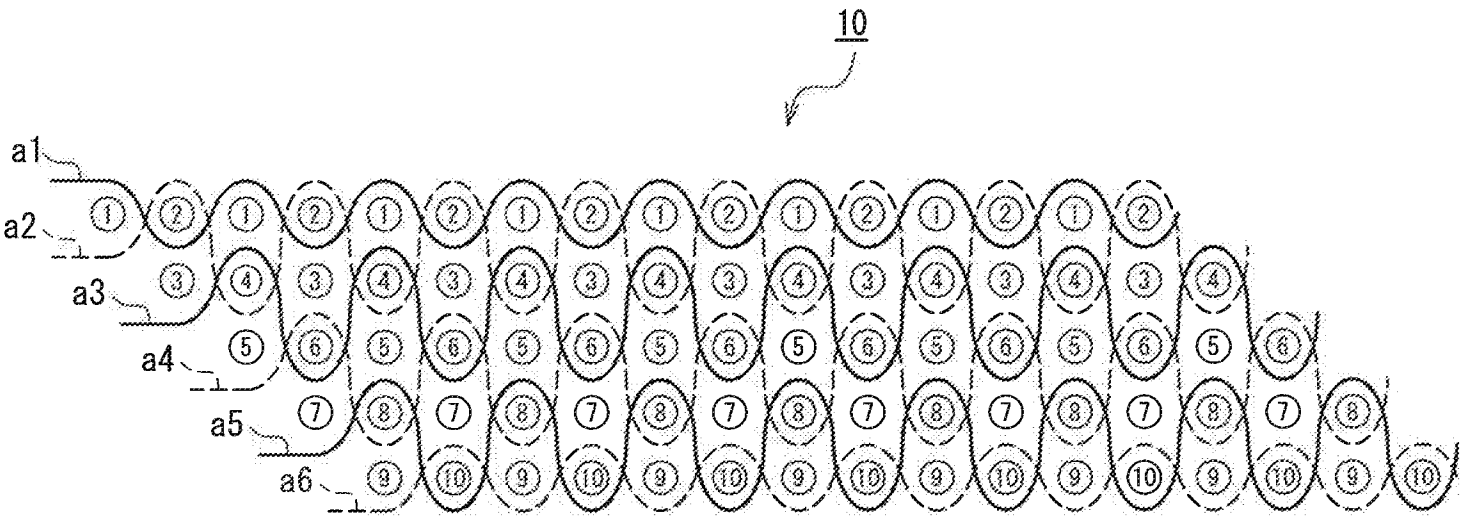
FIG. 7 is a cross-sectional weave diagram of a quintuple plain woven fabric in one embodiment of the present invention.

FIG. 7 is a cross-sectional weave diagram of a quintuple plain woven fabric 10 illustrated in FIG. 6. Reference numerals a1 to a6 indicate warps, and 1 to 10 in circles indicate wefts. The warp a1 on one outer side is arranged zigzag to alternately pass between the wefts 1 and 2 in circles (outermost layer), and the warp a6 on the other outer side is arranged zigzag to alternately pass between the wefts 9 and 10 in circles (outermost layer). The warps a2 to a5 in the inner layers are each arranged zigzag to alternately pass between two wefts adjacent to each other in the thickness direction. The wefts located, in the outermost layer, e.g., the wefts indicated by 1 and 2 in circles, are configured similarly to a plain woven fabric using the warps a1 and a2, but this structure is different therefrom in that the warp a2 is arranged to alternately pass between two wefts adjacent to each other in the thickness direction (2 and 3, and 1 and 4 in circles). The warps in the inner layers are each arranged to alternately pass between two wefts adjacent to each other in the thickness direction and pass between one weft in a horizontal direction. Although the number of layers is different, the structure of the quadruple plain woven fabric illustrated in FIG. 5 is basically the same as that of the quintuple plain woven fabric.

Figure 8:
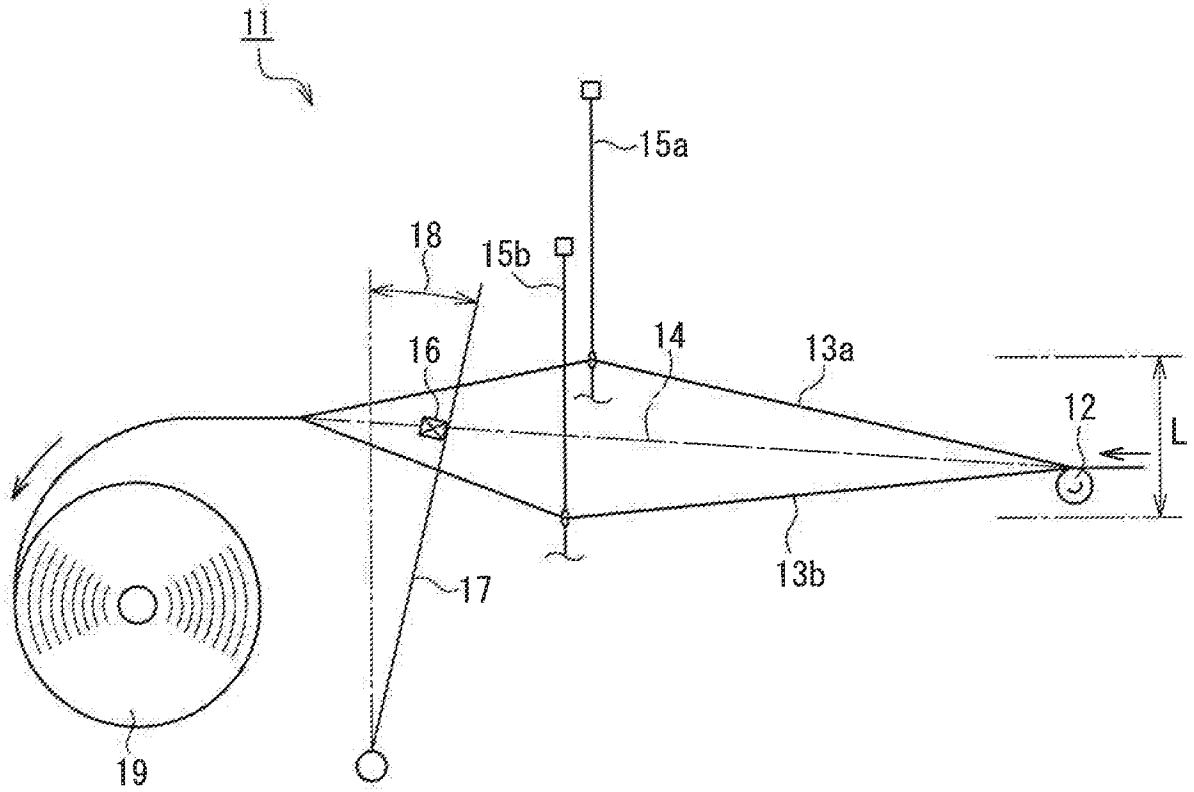
FIG. 8 is a schematic cross-sectional view illustrating a woven fabric production step in one embodiment of the present invention.

FIG. 8 is a schematic cross sectional view illustrating a step of producing a woven fabric in one embodiment of the present invention. A loom 11 to be used in the present invention is, e.g., a needle rapier loom. This needle rapier loom, which had been conventionally used for silk, was modified to have a distance L between the highest point and the lowest point of warps 13*a* and 13*b* of 80 mm to 120 mm, preferably 85 mm to 105 mm, at the time of moving the warps upward and downward with heddles 15*a* and 15*b*. Conventionally, the distance L was 55 mm to 75 mm. By increasing the distance L (shed) as such, the loom can be driven stably while a shuttle does not jump out on the warps, especially on the warps on the upper side, even at a reciprocation speed of the shuttle of, e.g., 130-150 times/minute, thereby reducing defects. Moreover, even when the weft is squeezed or rubbed by the reed, heddles, etc., of the loom, or the weft and the warp are rubbed, it is possible to produce a protective woven fabric that has few defects such as fluff or fiber aggregates while having a satisfactory weaving pattern. When the distance L between the highest point and the lowest point of the warps is less than 80 mm, problems increase, including the jump of the shuttle, and defects such as fluff or fiber aggregates. When the distance L exceeds 120 mm, the productivity decreases.

As illustrated in FIG. 8, a plurality of warps warped without using a sizing agent are arranged onto the loom 11, and passed through the heddles 15*a* and 15*b* from a back roll 12 to create a shed. The weft is inserted by passing a rapier shuttle 16 through the shed. A reference numeral 14 indicates a warp line. The weft is then beaten by moving a reed 17 frontward to form a fabric structure. A reference numeral 18 indicates the motion of the reed 17. A woven fabric thus produced is wound on a cylinder. A reference numeral 19 indicates the wound woven fabric.

EXAMPLES

Hereinafter, the present invention will be described specifically by way of examples. However, the present invention is not limited to the examples.

<Cutting Resistance Test>

A cutting resistance was measured in accordance with JIS-T8052 2005 (Protective clothing—Mechanical properties—Determination of resistance to cutting by sharp objects). The measurement method of JIS-T8052 2005 is the same as that of ISO 13997. The results obtained by this test are expressed as a cut resistance force (N) (a force required to cut a woven fabric). A cut resistance force of 100 N or more is indicated as "100 N or more". This test was conducted by KAKEN TEST CENTER General Incorporated Foundation, Tokyo office.

<Surface Inspection of Woven Fabric>

The surface of a woven fabric was evaluated by irradiating the front and back sides of the woven fabric with light (fluorescent lamp) over the full width to inspect defects of the woven fabric including fluff and fiber aggregates, and calculating the average number of defects present per 1 $m^2$ after removal with scissors. The defects were judged visually.

A: 0 to 2

B: more than 2 and 5 or less

C: more than 5

<Weaving Pattern Evaluation of Woven Fabric>

In parallel with the surface evaluation of the woven fabric, the weaving pattern of the woven fabric was judged visually.

A: Weaving pattern is satisfactory.

B: Weaving pattern slightly collapses but has no problem in practical use.

C: Weaving pattern collapses and is worthless as a product.

Example 1

(1) Warp

Two glass filament yarns (the number of constituent fibers: 800) having a fineness of 675 decitex were twisted together to prepare core yarns. The number of twists was 150 T/m (twist coefficient K: 5511), and the twist direction was S. A polyarylate spun yarn (trade name "VECTRAN (registered trademark)" manufactured by KURARAY Co., Ltd.) having a fineness of 295 decitex was twisted around the surface of the core yarns in a Z direction with the number of twists of 910 T/m (twist coefficient K: 15630), and another polyarylate spun yarn was twisted therearound in an S direction with the number of twists of 1180 T/m (twist coefficient K: 20267). Thus, a W covered yarn illustrated in FIG. 1B was prepared. The total fineness was 2150 decitex.

(2) Weft

A polyarylate filament fiber yarn (trade name "VECTRAN (registered trademark)" manufactured by KURARAY Co., Ltd., the number of twists: 25 T/m) having a fineness of 1100 decitex was used (the number of single fibers: 200).

(3) Production of Woven Fabric

A needle rapier loom, trade name "KR-Z" manufactured by Imamura-Machinery Co., Ltd, was used to produce the following woven fabric using 2070 warps and one weft (the weft was inserted with a rapier shuttle): the width of the woven fabric: 100 cm, the fabric structure: a 2/1 twill (monolayer woven fabric) illustrated in FIG. 3, the thickness of the woven fabric: 1.25 mm, the mass per unit area: 676 g/m$^2$ (the amount of the warp used: 474 g/m$^2$, the amount of the weft used: 202 g/m$^2$). This loom is illustrated in FIG. 8. The distance L between the highest point and the lowest point of the warps was 100 mm. As heddles, wire heddles with ring were used. The weft was inserted from the right side, seen from the upper side of the woven fabric. On the left end of the woven fabric, a selvedge was formed by intertwining the weft with an intertwining yarn and folding it. On the right end of the woven fabric, a selvedge was formed by intertwining the weft with the warp on the end.

(4) Evaluation Results of Woven Fabric

The woven fabric obtained had a cut resistance force of 31.9 N in the cutting resistance test, and was judged as A in the surface inspection test.

Example 2

A woven fabric of Example 2 was prepared in the same manner as in Example 1 except for the following: the number of the warp used: 2760, the fabric structure: a 2/2 twill (monolayer woven fabric) illustrated in FIG. 4, the thickness of the woven fabric: 1.48 mm, the mass per unit area: 918 g/m$^2$ (the amount of the warp used: 688 g/m$^2$, the amount of the weft used: 230 g/m$^2$). The woven fabric obtained had a cut resistance force of 51.5 N in the cutting resistance test, and was judged as A in the surface inspection. Incidentally, a double-layered woven fabric in which two of the woven fabrics were stacked had a cut resistance force of 100 N or more in the cutting resistance test.

Example 3

A woven fabric of Example 3 was prepared in the same manner as in Example 1 except for the following: the number of the warp used: 4140, the fineness of the weft: 560 decitex, the fabric structure: a quadruple plain woven fabric illustrated in FIG. 5, the thickness of the woven fabric: 2.35 mm, the mass per unit area: 1525 g/m$^2$ (the amount of the warp used: 1083 g/m$^2$, the amount of the weft used: 422 g/m$^2$). The woven fabric obtained had a cut resistance force of 100 N or more in the cutting resistance test, and was judged as A in the surface inspection.

Example 4

A woven fabric of Example 4 was prepared in the same manner as in Example 1 except for the following: the number of the warp used: 4140, the fineness of the weft: 560 decitex, the fabric structure: a quintuple plain woven fabric illustrated in FIGS. 6 and 7, the thickness of the woven fabric: 2.43 mm, the mass per unit area: 1458 g/m$^2$ (the amount of the warp used: 1035 g/m$^2$, the amount of the weft used: 423 g/m$^2$). The woven fabric obtained had a cut resistance force of 76.6 N in the cutting resistance test, and was judged as A in the surface inspection.

Table 1 summarizes the results of Examples 1-4.

TABLE 1

| | | Example 1 | Example 2 | Example 3 | Example 4 | Test method |
|---|---|---|---|---|---|---|
| Yarn density of woven fabric (number/2.54 cm) | Warp | 52.5 | 69.3 | 102.7 | 107.0 | JIS L 1096 |
| | Weft | 37.5 | 40.1 | 89.6 | 91.7 | |
| Mass of woven fabric (g/m$^2$) | | 676 | 918 | 1525 | 1458 | JIS L 1096 |
| Thickness of woven fabric (mm) | | 1.25 | 1.48 | 2.35 | 2.43 | JIS L 1096, load: 23.5 kPa |
| Tensile strength (N) | Warp | 4530 | 5680 | 6930 | 11400 | JIS L 1096 (Label strip method), Sample width: 5 cm, Distance between grips: 20 cm, Tensile rate: 20 cm/min, Test machine: constant-rate-of-extension type |
| | Weft | 18100 | 23100 | 42400 | 38400 | |
| Tear strength (N) | Warp | 343.0 | 433.0 | 804.7 | 862.0 | JIS L 1096 A-1 (Single tongue method), Sample width: 5 cm, Tensile rate: 0 cm/min |
| | Weft | 137.1 | 182.7 | 1816.0 | 1873.3 | |
| Dimensional change rate (%) | Warp | 0.0 | 0.0 | 0.0 | −0.3 | JIS L 1096 D |
| | Weft | 0.0 | 0.0 | 0.0 | 0.0 | |
| Cut resistance force (N) | | 31.9 | 51.5 | 100 or more | 76.6 | JIS T 8052 |

TABLE 1-continued

| | Example 1 | Example 2 | Example 3 | Example 4 | Test method |
|---|---|---|---|---|---|
| Surface inspection of woven fabric | A | A | A | A | Visual inspection |
| Weaving pattern evaluation of woven fabric | A | A | A | A | Visual inspection |

Comparative Example 1

A woven fabric of Comparative Example 1 was prepared in the same manner as in Example 1 except that an untwisted glass filament yarn was used as the warp. The woven fabric obtained was judged as C in the surface inspection, C in the weaving pattern evaluation, and had many defects and had a problem as a product.

Comparative Example 2

A woven fabric of Comparative Example 2 was prepared in the same manner as in Example 1 except that the same yarn as the warp was used as the weft. The woven fabric obtained was judged as B in the surface inspection, B in the weaving pattern evaluation, and had many defects and had a problem as a product.

Comparative Example 3

A woven fabric of Comparative Example 3 was prepared in the same manner as in Example 1 except that a conventional needle rapier loom was used as a loom, and the distance L between the highest point and the lowest point of the warps was 75 mm. The woven fabric obtained was judged as C in the surface inspection, C in the weaving pattern evaluation, and had many defects and had a problem as a product.

Example 5

A 2/1 twill woven fabric (monolayer woven fabric) was prepared in the same manner as in Example 1 except that the yarn density of the woven fabric was changed as indicated in Table 2. The woven fabric obtained had a cut resistance force of 52.1 N in the cutting resistance test, and was judged as A in the surface inspection. The other evaluation results are shown in Table 2.

Example 6

A 2/2 twill woven fabric (monolayer woven fabric) was prepared in the same manner as in Example 2 except that the yarn density of the woven fabric was changed as indicated in Table 2. The woven fabric obtained had a cut resistance force of 76.7 N in the cutting resistance test, and was judged as A in the surface inspection. The other evaluation results are shown in Table 2.

TABLE 2

| | | Example 5 | Example 6 | Test method |
|---|---|---|---|---|
| Yarn density of woven fabric (number/2.54 cm) | Warp | 52.5 | 70.0 | JIS L 1096 |
| | Weft | 41.7 | 50.1 | |
| Mass of woven fabric ($g/m^2$) | | 742 | 1002 | JIS L 1096 |
| Thickness of woven fabric (mm) | | 1.37 | 1.62 | JIS L 1096, Load: 23.5 kPa |
| Tensile strength (N) | Warp | 5210 | 6540 | JIS L 1096 (Label strip method), Sample width: 5 cm, Distance between grips: 20 cm, Tensile rate: 20 cm/min, Test machine: constant-rate-of-extension type |
| | Weft | 20820 | 26570 | |
| Dimensional change rate (%) | Warp | 0.0 | 0.0 | JIS L 1096 D |
| | Weft | 0.0 | 0.0 | |
| Cut resistance force (N) | | 52.1 | 76.7 | JIS T 8052 |
| Surface inspection of woven fabric | | A | A | Visual inspection |
| Weaving pattern evaluation of woven fabric | | A | A | Visual inspection |

It was confirmed from the results of Examples 5-6 that the woven fabric, even when being a monolayer woven fabric, could have a cut resistance force of 50 N or more in the cutting test in accordance with JIS-T8052, by increasing the yarn density. Particularly the monolayer woven fabric of Example 6 had a cut resistance force equivalent to that of the quintuple plain woven fabric of Example 4. Such a configuration can reduce the production cost.

INDUSTRIAL APPLICABILITY

The protective woven fabric of the present invention can be used as knife-resistant clothing, heat-resistant sheets, shock-resistant sheets, and the like. Examples of the knife-resistant clothing include knife-resistant vests, and leg protectors for chain saw work. Examples of the heat-resistant sheets include sheets for operations near a furnace such as a blast furnace or aluminum die cast, and sheets for welding. Examples of the shock-resistant sheets include human body protective sheets for fixing a human body to a protective position in a vehicle, and vehicle reinforcing sheets. In addition to these, the protective woven fabric of the present invention can be used at locations in, e.g., vehicles, trains, ships, minesweepers, submarines, chemical plants, and petroleum facilities, that are required to have shock resistance.

DESCRIPTION OF REFERENCE NUMERALS

1 single covered yarn
2*a*, 2*b* core yarn
3, 3*a*, 3*b*, 3*c* covering yarn
4, 5, 6 double covered yarn
7 additional yarn
10 quintuple plain woven fabric
11 loom
12 back roll
13*a*, 13*b* warp
14 warp line
15*a*, 15*b* heddle
16 rapier shuttle
17 reed
18 motion of reed
19 wound woven fabric

The invention claimed is:

1. A protective woven fabric comprising super fiber yarns, wherein a warp of the woven fabric is a covered yarn composed of two or more twisted inorganic filament yarns as core yarns and one or more super fiber yarns as covering yarns that are wound and twisted around the core yarns, and a weft of the woven fabric is an uncovered core super fiber yarn, wherein the inorganic filament yarns have a twist coefficient $K_1$ of 500 to 20000, the twist coefficient $K_1$ being determined by the following formula:

$$K_1=T\times D^{1/2}$$

where T represents a number of twists per 1 m of yarn, and D represents a fineness of the yarn (unit: decitex), wherein the covered yarn is a double covered yarn in which a twist coefficient $K_2$ of the covering yarns with respect to the core yarns is 2000 to 30000, the twist coefficient $K_2$ being determined by the following formula:

$$K_2=T\times D^{1/2}$$

where T represents the number of twists per 1 m of yarn, and D represents the fineness of the yarn (unit: decitex), wherein a force required to cut the woven fabric is 50 N or more, as measured through a cutting test in accordance with JIS-T8052.

2. The protective woven fabric according to claim 1, wherein the inorganic filament yarns are glass fiber yarns.

3. The protective woven fabric according to claim 1, wherein the super fiber yarns have a strength of 18 cN/decitex or more, and an elastic modulus of 380 cN/decitex or more.

4. The protective woven fabric according to claim 1, wherein the super fiber yarns are at least one selected from aramid fibers, polyarylate fibers, poly(p-phenylenebenzobisoxazole) (PBO) fibers, poly(p-phenylenebenzobisthiazole) (PBZT) fibers, polyethylene fibers, polyether ether ketone fibers, and polyvinyl alcohol fibers.

5. The protective woven fabric according to claim 1, wherein the protective woven fabric is at least one selected from a monolayer woven fabric and a multi-ply woven fabric including 2 to 5 layers.

6. The protective woven fabric according to claim 1, wherein the protective woven fabric is a monolayer woven fabric, and has a warp density of 50 yarns/2.54 cm or more and a weft density of 35 yarns/2.54 cm or more.

7. A method for producing a protective woven fabric comprising super fiber yarns, the method comprising:

intertwining a warp of the woven fabric and a weft of the woven fabric on a loom comprising a heddle, the warp being a covered yarn composed of two or more twisted inorganic filament yarns as core yarns and one or more super fiber yarns as covering yarns that are wound and twisted around the core yarns, and the weft being an uncovered core super fiber yarn, wherein the inorganic filament yarns have a twist coefficient $K_1$ of 500 to 20000, the twist coefficient $K_1$ being determined by the following formula:

$$K_1=T\Delta D^{1/2}$$

where T represents a number of twists per 1 m of yarn, and D represents a fineness of the yarn (unit: decitex);

the covered yarn is a double covered yarn in which a twist coefficient $K_2$ of the covering yarns with respect to the core yarns is 2000 to 30000, the twist coefficient $K_2$ being determined by the following formula:

$$K_2=T\times D^{1/2}$$

where T represents the number of twists per 1 m of yarn, and D represents the fineness of the yarn (unit: decitex);

at the time of moving the warp upward and downward by a heddle, a distance between a highest point and a lowest point of the warp is 80 mm or more and 120 mm or less, and a force required to cut the woven fabric is 50 N or more, as measured through a cutting test in accordance with JIS-T8052.

8. The method for producing a protective woven fabric according to claim 7, wherein the inorganic filament yarns are glass fiber yarns.

9. The method for producing a protective woven fabric according to claim 7, wherein the super fiber yarns have a strength of 18 cN/decitex or more, and an elastic modulus of 380 cN/decitex or more.

10. The method for producing a protective woven fabric according to claim 7, wherein the super fiber yarns are at least one selected from aramid fibers, polyarylate fibers, poly(p-phenylenebenzobisoxazole) (PBO) fibers, poly(p-phenylenebenzobisthiazole) (PBZT) fibers, polyethylene fibers, polyether ether ketone fibers, and polyvinyl alcohol fibers.

11. The method for producing a protective woven fabric according to claim 7, wherein the protective woven fabric is at least one selected from a monolayer woven fabric and a multi-ply woven fabric including 2 to 5 layers.

12. The method for producing a protective woven fabric according to claim 7, wherein the protective woven fabric is a monolayer woven fabric, and has a warp density of 50 yarns/2.54 cm or more and a weft density of 35 yarns/2.54 cm or more.

* * * * *